US007154060B2

(12) United States Patent
Rosenbaum et al.

(10) Patent No.: US 7,154,060 B2
(45) Date of Patent: Dec. 26, 2006

(54) PARCEL DISPATCH MANAGER SYSTEM AND METHOD

(75) Inventors: Walter Rosenbaum, Paris (FR); Ingolf Rauh, Reichenau (DE)

(73) Assignee: Siemens Dematic AG, Nuremberg (DE)

( * ) Notice: Subject to any disclaimer, the term of this patent is extended or adjusted under 35 U.S.C. 154(b) by 1169 days.

(21) Appl. No.: 09/969,973

(22) Filed: Oct. 4, 2001

(65) Prior Publication Data

US 2004/0118907 A1 Jun. 24, 2004

(51) Int. Cl.
*B07C 5/00* (2006.01)

(52) U.S. Cl. ..... 209/584; 209/900; 700/224; 700/226

(58) Field of Classification Search ..... 209/583, 209/584, 900; 700/223–226
See application file for complete search history.

(56) References Cited

U.S. PATENT DOCUMENTS 5,009,321 A * 4/1991 Keough ..... 209/3.1
5,220,511 A * 6/1993 Speckhart et al. ..... 700/223
5,804,802 A * 9/1998 Card et al. ..... 235/375
5,957,296 A * 9/1999 Altenburg et al. ..... 209/3.3
2003/0038065 A1 * 2/2003 Pippin et al. ..... 209/584
2005/0076047 A1 * 4/2005 Starrett ..... 707/101

FOREIGN PATENT DOCUMENTS

EP 1298552 A1 * 4/2003

* cited by examiner

*Primary Examiner*—Joseph C. Rodriguez
(74) *Attorney, Agent, or Firm*—Siemens AG

(57) ABSTRACT

A system and method are set out for automating the sorting and loading of parcels into a delivery vehicle. While being conveyed from a customer, parcels to be delivered are scanned and information obtained therefrom. The information may be the parcel either or both the identification code and delivery address. The obtaining may be performed by a bar code reader, hand held or overhead, as well as a videocoding device. The parcel information is matched to a sort code, a unique code for a unique delivery address. A list of matched identification and sort codes and delivery addresses and sort codes is then saved for later search, sort, and retrieval. The parcels are then loaded in sequence into mobile racks, which when full, is loaded onto the delivery vehicle. A sequence list of the order in which the parcels were scanned is also saved for later search, sort, and retrieval. An end user enters a select list of addresses in search of possible hits from the saved lists. A hit list is generated and sorted by the order of addresses in the search list. Alternative sort options are also available.

12 Claims, 4 Drawing Sheets

PARCEL DISPATCH MANAGER SYSTEM AND METHOD

BACKGROUND OF THE INVENTION

The present invention relates to parcel sorting and delivery and more particularly to a parcel sorting system and method for automating manifest generation, parcel placement in racks, and latter controlled access to the parcels. The invention has use in parcel delivery and in particular to steps taken during preparation of delivery vehicles for their delivery rounds.

Parcels are delivered by public and private concerns, including national post offices like the United States Postal Service and corporate delivery services like Federal Express and DHL. Parcels arrive at a central location and are distributed to delivery vehicles which will complete the last leg of the parcels journey to the delivery address. Delivery vehicle drivers usually wait for their parcels by a conveyor belt or the like. It is the driver responsibility to note the delivery addresses of the parcels, plan a delivery route according to the addresses, and load the delivery vehicle in an ordered manner such that parcels can be later retrieved. These tasks are time consuming, tedious, stressful and prone to human error. Where an error is made with a parcel, the driver must redirect his route and/or a delay occurs in parcel delivery. As with all businesses, the pressures on the driver are passed to the delivery service which is ever mindful of balancing quality, customer service and costs while providing additional services like alternate delivery addresses—yet another consideration for the driver. Accordingly, a need exists for tools to assist the driver and delivery service with the aforementioned burdens.

SUMMARY OF THE INVENTION

It is an advantage of the present invention to relieve the driver of the burdens of sorting and loading parcels as well as generating a manifest and planning a delivery route. It is a further advantage to free up the driver's preparation time so that more time is available for deliveries and customer service. It is a further advantage to provide the delivery service with a delivery preparation scheme having reduced error while mindful of alternative delivery services. These and other advantages are realized by a system and method for automatically sorting parcels as they are loaded onto delivery trucks, generating and updating parcel manifests, and optimizing delivery routes. In operation, an identifier or parcel information, such an identification (ID) code and/or delivery address, is read off of a parcel by scanning as the parcel is conveyed to a loading rack. The parcel is sequentially loaded into a sequential position within the rack. Once a rack is full, or no more parcels are present for delivery, the rack is loaded onto a delivery vehicle. Parcel identifiers or information is matched to a sorting code. The resulting match (or assignment) list is then stored in at least one database. The sorting code is a unique code identifying a unique delivery address. Consideration is also given to preexisting arrangements present for the parcel's delivery—such as an alternate address which is substituted into the parcel data. A search is performed of the match list for delivery addresses along a particular delivery route. A hit list is generated which is then sorted, e.g. by routing software, to an order consistent with a time optimized delivery route. A manifest is then generated with the sorted hit list and other information.

The advantages are further realized by a method of sorting parcels, comprising the steps of: decoding a parcel identifier; matching said identifier to a sort code, said sort code uniquely associated with a delivery address; loading said parcel into a rack space; repeating said steps of decoding, matching loading for a plurality of parcels; generating a first list comprising identifiers matched to sort codes; generating a second list comprising parcel sequence and rack space; merging said first and second list to form a third list; cross checking said third list with a fourth list for possible matches therebetween; and generating a fifth list comprising said possible matches.

The advantages are still further realized by a system for automating parcel sorting, comprising: a scanner for decoding a plurality of parcels identifiers in a first sequence; computer means comprising: a first interface for receiving decoded identifiers; matching means for matching decoded identifiers with sort codes; compiling means for generating a first list of said matching; a second interface for receiving a second list comprising said first sequence; merging means for merging said first list and said second list; a second interface for receiving a third list, said third list comprising a plurality of identifiers; and comparing means for comparing said third list and said second list and generating a fourth list of matches; and computer input means in communication with said second interface, said computer input means generating said third list.

These and other advantages will become clear from the following detailed description and appended claims. The invention will be described in accordance with the following figures wherein like numerals refer to like parts.

DETAILED DESCRIPTION OF THE INVENTION

The present invention is directed to a parcel dispatch manager system and manager (PDM). The PDM may comprise a computer having a processor, memory, input and output means. Computer may incorporate a client-server arrangement. Software, operating on the computer causes the relevant method steps below to take place. The software is not limited to a particular language or algorithm but for execution of the method below. Accordingly, the software can be generated by one skilled in the art. Likewise, the hardware and computer configuration is a matter of design choice.

Figure 1:
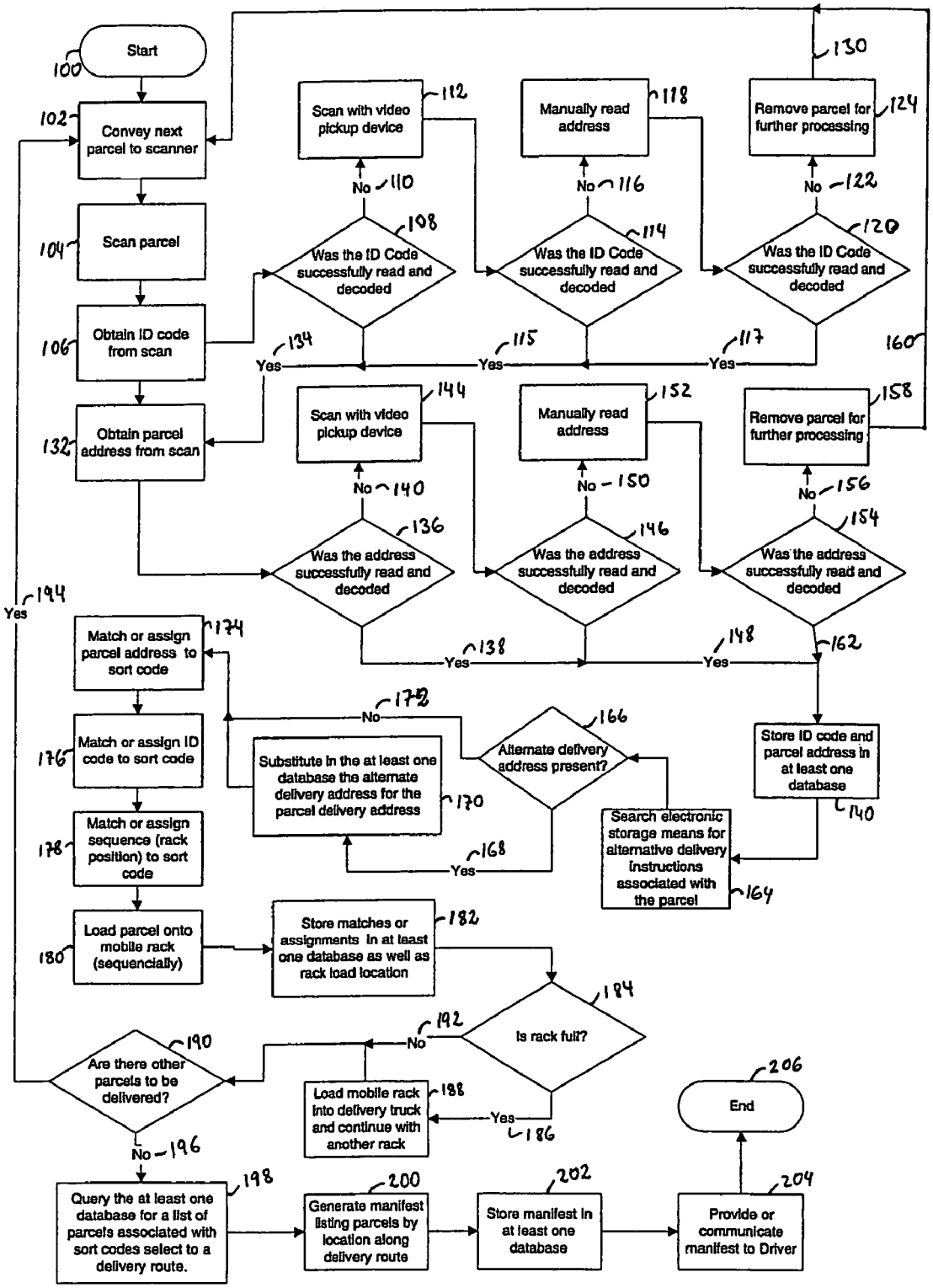
FIG. 1 depicts a flowchart of the present method.

FIG. 1 depicts a flowchart of the present method. The method begins at 100 and proceeds to the next step of conveying a parcel to a scanner 102. Conveyance is normally performed by a conveyor belt or similar such means. The parcel includes several identifiers or information, including an identification (ID) code and delivery address. The parcel is scanned 104 and an attempt to obtain the ID code is made 106. The ID code, as is known in the art, uniquely identifies the parcel and may comprise a bar code (not shown). A determination is made whether the ID code scan was successful (decodable) 108. If the scan was successful 134, the method continues to step 132. If the scan was unsuccessful 110, a second scan is attempted with a videocoding device 112. A second determination is made whether the scan was successful 114, and if not 116, the ID code is manually read 118. If the scan was successful 115, the method continues to step 132. A third determination is made whether the ID code was successfully read, 120, and if not 122, the parcel is removed from circulation for further processing 124. The method then returns 130 to the next parcel to be conveyed 102. If the read was successful 117, the method continues to step 132. Alternatively, method may continue to the step of obtaining the address from the parcel scan (132) and omit all future steps involving the ID code.

An attempt is then made to obtain the address from the scan of the parcel 132. A determination is made whether the address was successfully read by the scan 136. If the scan was successful (138) the method continues to step 140 wherein the ID code and address are stored in at least one database. If the address scan was not successfully read 142, the scan is repeated with the videocoding device 144. A determination is again made whether the scan successfully read the address 146. If the scan was successful (148 ) the method continues to step 140. Where the scan, via the videocoding device, was unsuccessful (150) the parcel address is manually read 152. A determination is made whether the address is manually readable 154. If the read was successful, the method continues to step 140. If the address is not readable 156, the parcel is set aside for further processing 158. Such processing may include sending the parcel back to the sender or customer, disposal, and the like. The method then returns 160 to step 102. Where the address is readable via manual inspection (162), the method continues to step 140. The ID code and parcel address may be stored in the same or different databases located locally or remotely as a matter of design choice.

A search is conducted of a storage medium containing service agreements and other understandings effected between customer and delivery service 164. The storage medium may be the at least one database. The search is part of a determination of whether the service agreement or understanding (if present) includes an alternate delivery address associated with the parcel or destination address 166. The alternate delivery address may also be effected by the recipient at the delivery address, as may occur from a vacation or relocation. Such alternate delivery addresses may include other delivery locations, holding the parcel at franchise, lock box, local post office or delivery service, etc. Where it is determined that an alternate delivery address is present 168, the alternate delivery address is substituted for the delivery address 170 at the stored location effected during step 140. Where no alternate delivery address is found 172, a matching of the parcel address to a sort code is made 174. Sort codes are unique codes that identify a unique destination. ID Codes are then matched to the sort codes 176 by methods known in the art. The sequence from which the parcels were scanned is also matched to the sort codes 178. The parcels are loaded, manually or automatically, onto a mobile rack, in the sequence of receipt and scan 180. The lists of matches (or assignments) are stored in the at least one database separately or complied into one formal list and stored in a single (or with backup) location 182.

Figure 6:
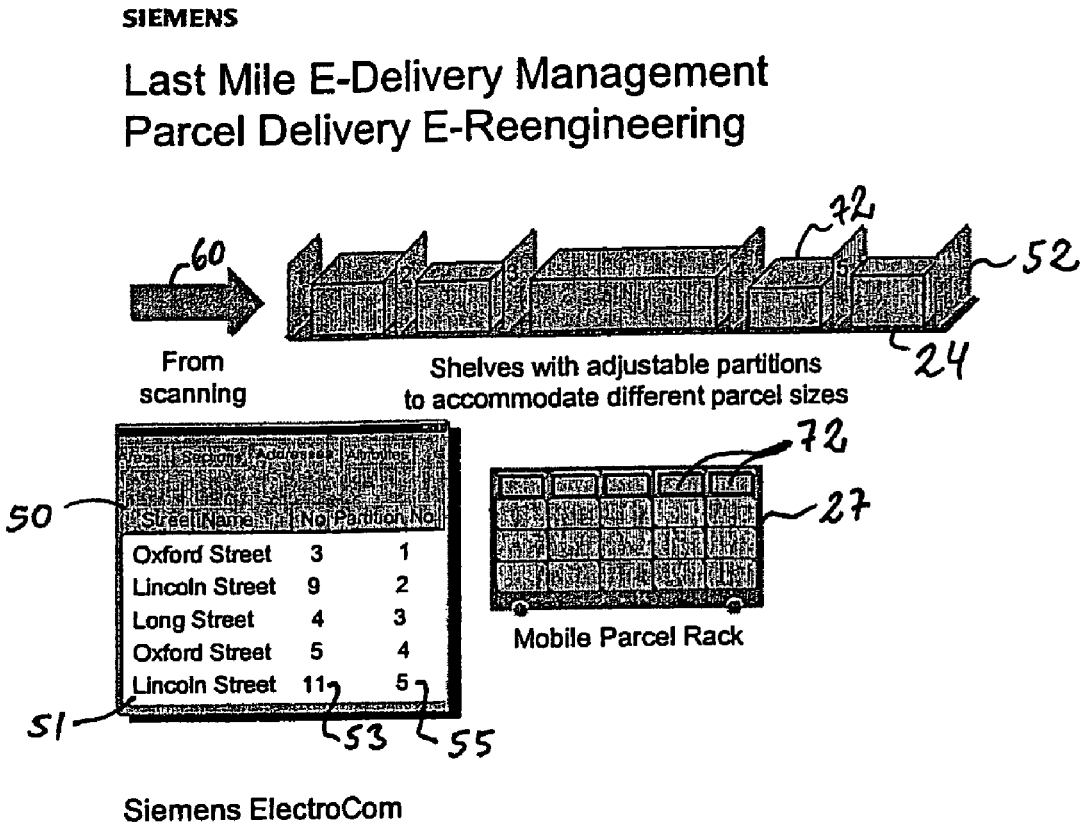
FIG. 6 depicts a manifest and mobile rack.

A determination is made whether the mobile rack is full 184. If the rack is full 186, the rack is loaded onto the delivery truck and a new rack is introduced to receive parcels 188. And the method continues to step 190. If the rack is not full 192, the method continues to step 190, wherein, a determination is made whether there are other parcels to be delivered along the route of the delivery vehicle. If other parcels are present 194, the method returns to step 102 and the next parcel is scanned. If there are no more parcels to be scanned 196, the at least one database will now contain a list of all of the scanned parcels sorted by sort code. The at least one database is now queried for a list of all parcels matching select sort codes (or delivery addresses 0, the select sort codes being along a particular delivery route 198. A hit list is generated and sorted and produced in a manifest with the aid of routing software 200. The hit list may be ordered such that the driver's stops are minimized along a select route. The routing software is known in the art. The hit list will contain at least a rack location, delivery address and order of delivery (50, FIG. 6). The manifest is stored in the at least one database 202 and communicated to the delivery vehicle driver via paper or electronic format 204. An optional map detailing the route and delivery may also be provided. The latter instance, the driver is equipped with a mobile data receiving device such as a personal digital assistant, mobile telephone and the like. The method then ends 206.

Figure 2:
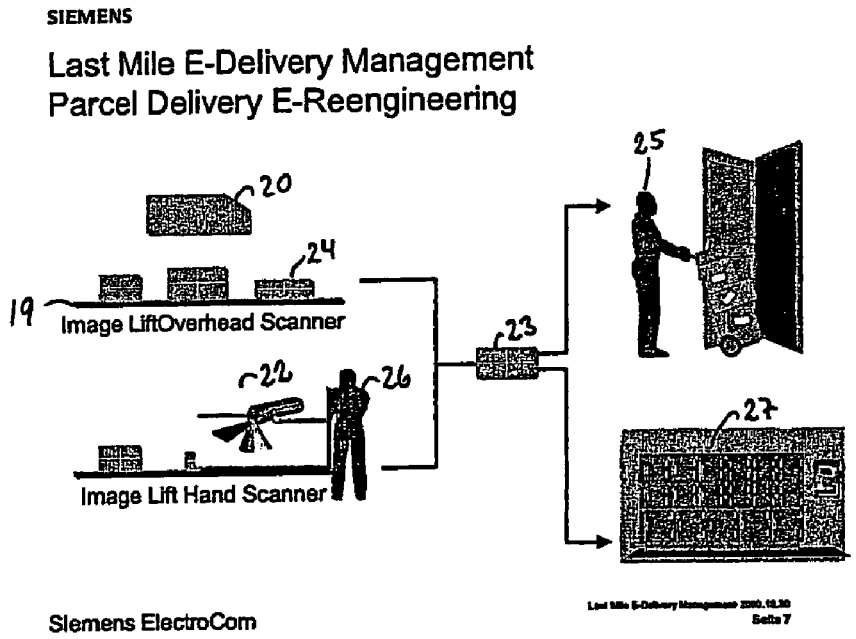
FIG. 2 depicts an overview of the present system.

FIG. 2 depicts an embodiment of the present system. Herein parcels 24 are transported by conveyor belt 19 below an overhead scanner 20. The scanner 20 may comprises a bar code reader, videocoding device or other optical scanning apparatus. The scanner 20 may further include optical character recognition means where necessary. Scanner 20 obtains the ID code and delivery address from parcel 24 which are then directed to PDM 23. As an alternative to an overhead scanner, a hand held scanner 22 may be employed with the data so obtained also directed to PDM 23. Parcels are then either loaded onto mobile rack(s) 27 in the order of conveyance or manually set aside 25 for further handling.

Figure 3:
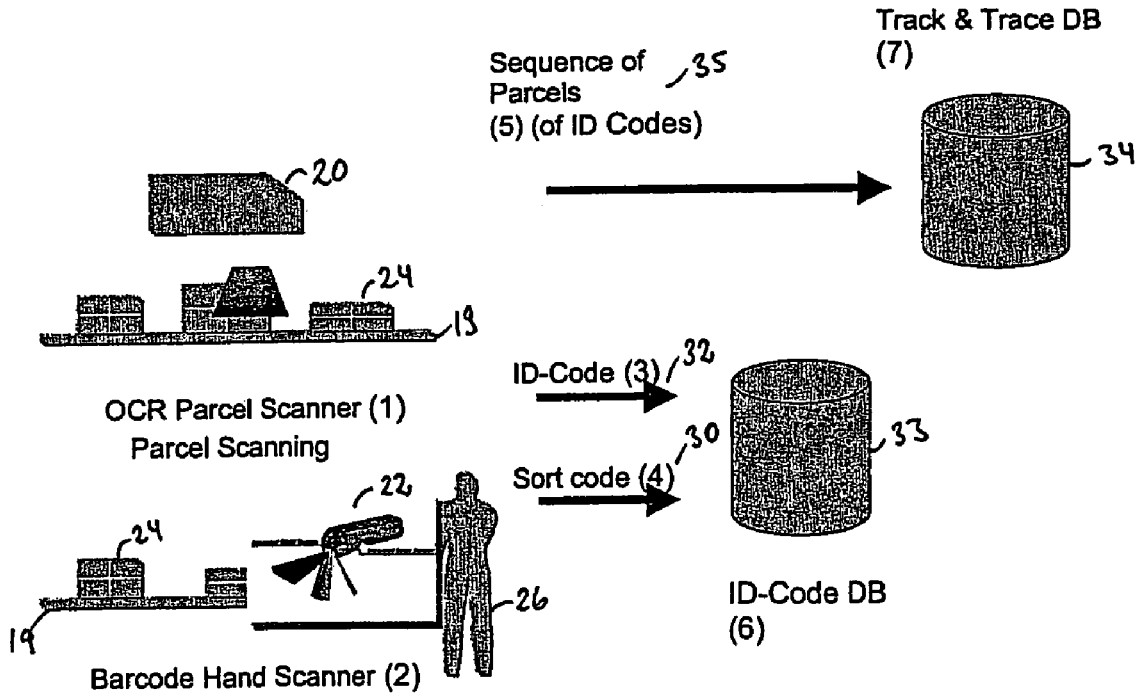
FIG. 3 depicts flow of data according to the invention.

FIG. 3 depicts databases arranged to receive parcel data. The ID codes 30 and sort codes 32 are matched, by the PDM performing a method known in the art, and stored, as a first list, in a first database 33, ID-Code database. The sequence in which the parcels were conveyed or scanned (bar code and/or videocoding) 35 is stored, as a second list, in a second database 34, Track & Trace database. Like elements are assigned like numerals throughout the figures.

Figure 4:
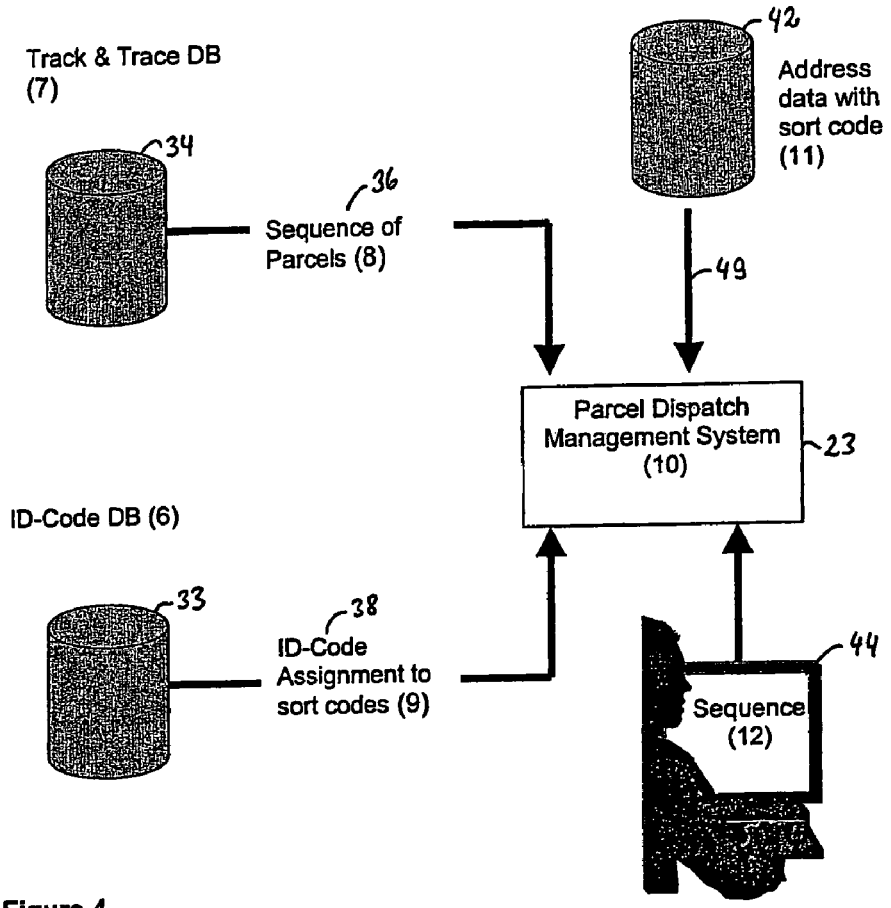
FIG. 4 depicts interface of database according to the invention.
Figure 5:
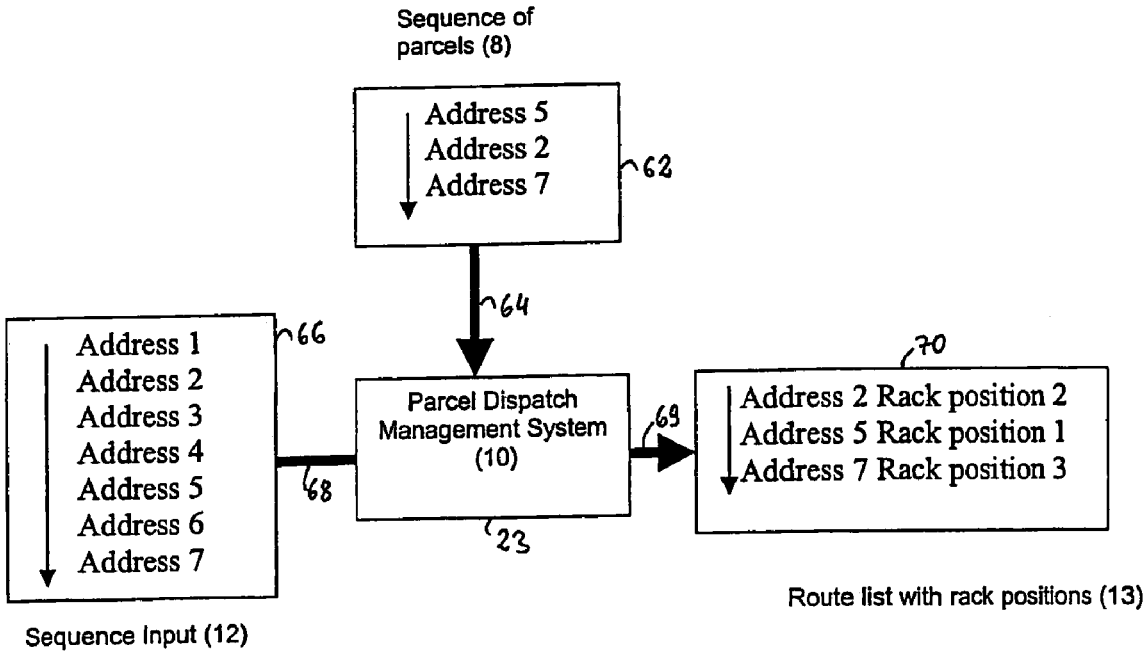
FIG. 5 depicts data sorting according to the invention.

FIG. 4 depicts the collecting of data by the PDM 23. The matched ID codes and sort codes are retrieved 38 from database 33. Addresses are assigned to the sort codes, via a matching procedure performed by the PDM. The matching procedure is known in the art. The addresses are retrieved from an address database 42. Where the addresses are already known from the parcel, this step is omitted. The sequence of parcels 35 is also retrieved 36 from database 34. The PDM then receives a search query, from user 44, for all hits along a particular sequence of addresses. FIG. 5 depicts execution of this search. Herein a sequence of parcels 62 (matched ID codes with sort codes and/or delivery addresses with sort codes), as a third list, is searched 64 for matches or hits with a list of addresses 66 inputted 68 into the PDM 23 as a fourth list by end user 44 (FIG. 4). As a fifth list, an output list 70 is produced 69 setting out the matched addresses (herein addresses 2, 5, 7), in the order of the sequence input 42 (herein numerical) along with rack position(s) of the parcels associated (via sort code or delivery address) with the resulting addresses (2, 5, 7). The output may be generated in the form of a manifest 50 depicted in figure 6. Herein, an address 51 appears, along side a sequence number 53 of which the parcel was loaded into the rack and partition number (rack location) 55. The lists may be sorted in any order imagined by one skilled in the art. A mobile parcel rack 27 is also depicted having numerous spaces 72 for parcels. A close up of the spaces and their moveable partitions 52 is also depicted. Arrow 60 indicates the order of loading the parcels from the scanning operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of sorting parcels, comprising the steps of:

decoding a parcel identifier;

matching said identifier to a sort code, said sort code uniquely associated with a delivery address;

loading said parcel into a rack space;

repeating said steps of decoding, matching and loading for a plurality of parcels;

generating a first list comprising identifiers matched to sort codes;

generating a second list comprising parcel sequence and rack space;

merging said first and second list to form a third list;

cross checking said third list with a fourth list for possible matches therebetween; and generating a fifth list comprising said possible matches.

2. The method according to claim 1, further comprising the steps of:

storing said first list in a first database, said second list in a second database;

sorting said fifth list in order of delivery address along a delivery route; and generating a manifest comprising said sorted fifth list.

3. The method according to claim 2, wherein said identifier comprises an identification code.

4. The method according to claim 3, wherein said identifier also comprises a delivery address.

5. The method according to claim 2, wherein said identifier comprises a delivery address.

6. The method according to claim 2, wherein said step of decoding, further comprises the step of scanning said parcels with an optical scanner and decoding characters on said parcels, said characters comprising said identifier.

7. The method according to claim 6, wherein said optical scanner is an overhead bar code reader and said characters are bar codes, and said step of decoding further comprises the step of automatically conveying said parcels below said overhead scanner.

8. The method according to claim 6, wherein said optical scanner is a hand held bar code reader and said characters are bar codes.

9. The method according to claim 6, wherein said optical scanner is a videocoding device including optical character recognition means, and said characters are alphanumeric characters.

10. The method according to claim 1, wherein said racks are mobile racks comprising movable partitions.

11. The method according to claim 10, wherein said plurality of parcels are loaded sequentially into sequential positions in said mobile racks, said sequential positions defined by said movable partitions.

12. The method according to claim 1, wherein said first list further comprises delivery addresses matched to said sort codes.

* * * * *